United States Patent [19]

Percic et al.

[11] Patent Number: 4,557,583

[45] Date of Patent: Dec. 10, 1985

[54] APPARATUS FOR TRANSFERRING A TONER IMAGE FROM A PHOTOCONDUCTIVE COATING TO A PRINT SHEET

[75] Inventors: Milan Percic, VN Boxmeer; Hubertus J. Schoonderbeek, KK Beuningen, both of Netherlands; Julia M. Alston, Myrtlebank, Australia

[73] Assignee: Coulter Stork Patents B.V., Amsterdam, Netherlands

[21] Appl. No.: 527,653

[22] PCT Filed: Dec. 14, 1982

[86] PCT No.: PCT/EP82/00266

§ 371 Date: Aug. 11, 1983

§ 102(e) Date: Aug. 11, 1983

[30] Foreign Application Priority Data

Dec. 16, 1981 [NL] Netherlands ..... 8105676

[51] Int. Cl.[4] ..... G03G 15/16

[52] U.S. Cl. ..... 355/3 TR; 355/14 TR

[58] Field of Search ..... 355/3 R, 3 TE, 3 TR, 355/14 TR

[56] References Cited

U.S. PATENT DOCUMENTS 3,063,351 11/1962 Medley ..... 355/3 TR
3,653,891 4/1972 Thourson et al. ..... 355/3 TE X
3,702,482 11/1972 Dolcimascolo et al. .... 355/3 TR X
3,761,174 9/1973 Davidson ..... 355/12 X
3,862,848 1/1975 Marley ..... 355/10 X
4,182,266 1/1980 Alston ..... 355/3 TR X

*Primary Examiner*—Fred L. Braun

*Attorney, Agent, or Firm*—Silverman, Cass & Singer, Ltd.

[57] ABSTRACT

Apparatus for transferring a toner image from a photoconductive coating to a print sheet (which is fixed on a drum) using an intermediate transfer sheet. A pair of axially parallel electrically polarized rollers are placed between the one side of photoconductor surface and the drum. A print sheet is mounted on the drum and a transfer sheet is mounted on the drum over the print sheet. The free end of the transfer sheet is fixed. The transfer sheet is rolled over the toned photoconductor surface in a first direction. A return movement is effected. The polarization is such that the toner is retained on the photoconductor surface during the first movement and during the return movement, the transfer sheet is wound on the drum with the top roller polarized to transfer the toner from the photoconductor to the transfer sheet. The bottom roller cooperates with the drum surface and is electrically polarized to retain the toner on the transfer sheet. Thereafter, the drum and pair of rollers are moved away from the photoconductor surface resulting in the unwinding of the transfer sheet from the drum during which the bottom roller is polarized to transfer the toner from the transfer sheet to the print sheet on the drum.

13 Claims, 12 Drawing Figures

APPARATUS FOR TRANSFERRING A TONER IMAGE FROM A PHOTOCONDUCTIVE COATING TO A PRINT SHEET

BACKGROUND OF THE INVENTION

1. Field of the Invention

This invention relates generally to xerography and, more particularly, to apparatus for transferring a toner image formed on a photoconductive coating to a print sheet.

2. Description of the Prior Art

The general state of the art with which the present invention is concerned is described in French Pat. No. 2,002,025 dated Oct. 3, 1969.

The operating principles of the apparatus with which the present invention is concerned are disclosed in U.S. Pat. No. 4,182,266 which describes an embodiment in which the sheets are held in place by register pins. Although the embodiment described in said patent is suited for laboratory uses, it cannot be used commercially because handling of the sheets is clumsy and time-consuming. Further, in order to obtain a sharp and well-defined final image, smudge-free transfer of toner is a pre-requisite and it is necessary to ensure that no movement takes place during transfer of toner between the transfer sheet and the coating and between the transfer sheet and the print sheet. The embodiment described in said patent does not meet this requirement. Additionally, the apparatus preferably should be compact and simple in construction and suitable for dealing with images of different formats.

The structure of the present invention provides an apparatus which satisfies the above requirements.

SUMMARY OF THE INVENTION

Apparatus and method for transferring a toned image from a photoconductive image arranged facing downwardly to a flexible transfer sheet whereas the transfer sheet is pressed progressively against the toned surface across the surface in one direction and peeled from the surface in an opposite direction, means mounting a print sheet on a drum and mounting the transfer sheet on the drum superposed on the print sheet, means for fixing one end of the transfer sheet, and exerting tension therein at its opposite end to resist but not prevent movement of the transfer sheet vertically upward and laterally unwinding same from the drum, electrically polarized roller means for applying pressure along first and second lines transversely of the receptor sheet and against the toned surface, means for moving the pressure lines along the toned surface maintaining the spacing and tautness of the transfer sheet between said pressure exerting means and the fixed end, one line of pressure being relieved at the end of the stroke and peeling the opposite end from the second line away from the surface along with the area thereof that was between the pressure lines, rewinding the transfer sheet on the drum over the print sheet and completing transfer from the transfer sheet to the print sheet.

DESCRIPTION OF THE PREFERRED EMBODIMENTS

Figure 1:
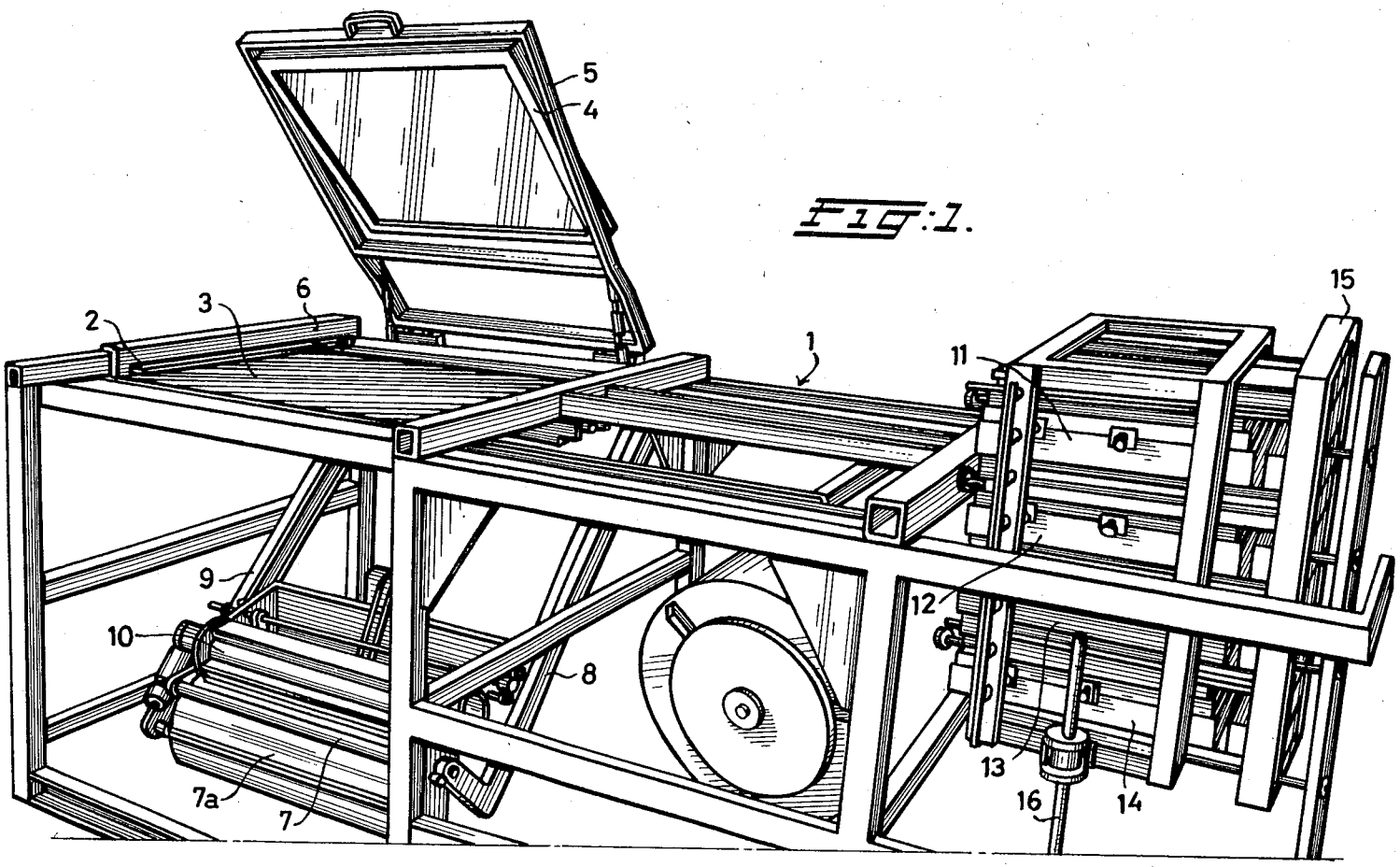
FIG. 1 is a fragmentary perspective view of an apparatus constructed in accordance with the invention.

The invention described hereinafter is embodied in apparatus for transferring a toner image formed on a photoconductive coating to a print sheet. The apparatus includes a roller for respectively pressing the surface of a transfer sheet over the surface of said coating and peeling the transfer sheet off from said coating. The roller is maintained during the pressing movement at a potential having a polarity identical to that of the toner charge and during the peeling off movement at a potential having a polarity opposite to that of the toner charge to enable transfer of the toner image to the transfer sheet. The apparatus also includes means for subsequent transfer of said toner image from the transfer sheet of the print sheet.

A preferred embodiment of the invention comprises an acceptor drum retained in a frame and movable from an initial position along the surface of the photoconductive coating near one end thereof to the other end of the coating and back again. The drum has means provided thereon for holding the print sheet, which accepts the final image, and a first transfer sheet wound around the drum, and connected for movement therewith. Two guide rollers also are connected for movement with the drum, each arranged parallel to the drum at a short distance from each other. The rollers may be brought, independently of each other, to a potential of suitable polarity. One of the rollers, located farthest from the drum, can be activated for transfer of toner from the photoconductive coating to the transfer sheet; the other roller can be activated for transfer of toner from the transfer sheet to the print sheet which is wound around the drum. The direction of winding on the drum is such that during winding of the transfer sheet on the drum the side of the transfer sheet carrying the toner image faces the surface of the print sheet to which the final toner image is to be transferred.

Since the positions of the referred-to sheets are rigidly fixed with respect to each other several representations, e.g. color images in the different basic colors, can be moved to registration easily and quickly one on top of the other. During this procedure it is necessary only to ensure that the originals which form the partial images all have a mutually identical position with respect to the fixing element of the transfer sheet while the photoconductive coating is being exposed through them.

Preferably during unwinding of the transfer sheet along the photoconductive coating, the top roller located farthest from the drum is maintained at a first potential having a polarity identical with that of the toner polarity, and the other roller is maintained at a second potential, e.g. earth potential. During "peeling off" of the transfer sheet from the photoconductive coating while toner is simultaneously being transferred from the coating to the transfer sheet, the top roller is maintained at a third potential having a polarity opposite to that of the toner polarity, and the other roller is maintained at a fourth potential having a polarity which is similarly opposed to the toner polarity. During the subsequent renewed unwinding of the transfer sheet, while toner is simultaneously transferred to the print sheet, the top roller is maintained at a potential which is, for example, earth potential and the other roller is maintained at a sixth potential, the polarity of which is identical with that of the toner polarity.

When employing positive toners, the first potential is approximately +50 Volt and the second potential earth potential, the third potential being approximately −800 Volt and the fourth potential −50 Volt, while the fifth potential is earth potential and the sixth potential is +1000 Volt.

Preferably, control and driving of the frame which supports the drum is performed in such a way that after the transfer sheet is wound on the drum the frame can be moved in a direction away from the coating during unwinding of the transfer sheet. In this manner, while the toner image is transferred from the transfer sheet to the print sheet, the space beneath the photoconductive coating is free for operations such as cleaning of the coating. Preferably, a flat support with a photoconductive coating on both sides is used so that during development and transfer of toner image from the downward facing coating the top coating is charged and exposed after which, following cleaning of the bottom coating, the support is rotated 180°.

Good images are obtained by using a moistening device which can be moved together with the drum and the means for driving and controlling the drum in such a way that during unwinding of the sheet along the photoconductive coating, the sheet is unwound from the drum together with the print sheet while simultaneously being moistened with solvent, and subsequently is re-wound on the drum.

The referred-to moistening device can consist of an oblong chamber with a slot-like liquid discharge aperture and a brush driven in rotary fashion accommodated therein with the brush hairs interacting with a doctor blade arranged close to the discharge aperture. However, a simple moistening device preferably comprises an oblong downwardly inclined surface, positioned with one edge near the drum and with its opposite edge below a plurality of outlets for the controlled supply of solvent over the surface, the outlets preferably being formed in one side wall of an oblong chamber positioned above said surface.

A favorable structure is obtained when the photoconductive coating assumes an essentially horizontal position while the transfer sheet is moving therealong. This facilitates the cleaning and application of toner carrier liquid onto the coating because the apparatus required for this purpose need only traverse a horizontal path and can be of a relatively simple structure.

A toner feed device can be used with the above structure. Such toner feed device can be moved in two mutually opposite directions along the photoconductive coating, and a suction nozzle and toner carrier liquid feed device can be arranged close to the toner feed device and movable therewith along the coating. The device can be controlled such that during the return movement of the toner feed device after toner is supplied, excess toner is sucked away from the coating and a small quanity of toner carrier liquid is supplied thereto.

Preferably, the toner carrier liquid feed device includes a narrow overflow chamber which is open at the top and moves along the photoconductive coating. The chamber is connected to a toner liquid feed pipe and accommodated in and projecting from an intercept holder which is provided with a toner-liquid discharge.

With certain kinds of photoconductive coatings, e.g. zinc oxide coatings, better results are obtained by using a moistening device for moistening the surface of the photoconductive coating with toner solvent prior to the application of toner thereto and also provides a suction device to dry the print and/or transfer sheet.

Referring to the drawings, FIG. 1 illustrates the general layout of an apparatus constructed in accordance with the invention. Said apparatus comprises a frame 1, with a flat support located on the left side of the apparatus as viewed in the Figure. The support has a photoconductive coating on both sides, the top side of which is indicated by reference numeral 3. The support 2 is rotatable about a horizontal shaft (not shown) which extends lengthwide with respect to the frame. The original document to be copied is placed on the photoconductive coating 3 and pressed thereagainst by the pressure frame 4 which is retained in pressure frame holder 5. The photoconductive coating is charged by a conventional corona charging unit 6 which can move across the coating.

Drum 7 is mounted beneath support 2 on the arms 8, 9, and is capable of movement underneath and along said support by a guide (not shown) which is located on the underside of the support 2. A housing 7*a* is positioned around the drum 7 and connected to an air suction pipe (not shown). The complete assembly is connected to a moistening unit 10 which will be described in more detail below.

On the right hand side of the frame as viewed in FIG. 1, there are four toner holders 11–14 retained in a frame 15 which is adjustable in height by means of the guide 16 so that a selected toner holder can be moved to a level position with the bottom surface of a photoconductive coating on the support 2. During movement of a toner holder underneath the coating, toner can be supplied for the development of a charge pattern present thereon.

To form a toner image, first the photoconductive coating 3 is charged to a suitable potential by means of the corona arrangement 6. Next, the coating is exposed by a light-transmitting original and subsequently, the support 2 is tilted through 180° so that the coating, which has been exposed, is returned to horizontal but facing downwards. At locations where radiation has reached the charged surface the charge originally present has, depending upon local radiation intensity, more or less leaked away so that a charge pattern of the original is formed. By performing developing with toner in the conventional manner, the image is rendered visible. This technique is known in the art.

The present invention relates particularly to transfer of the image formed in the above manner to a receptive substrate, e.g. a sheet of paper.

The manner of operation of the invention is illustrated in FIGS. 2–6 which are schematic views showing the right-hand side of the apparatus seen in FIG. 1.

Figure 2:
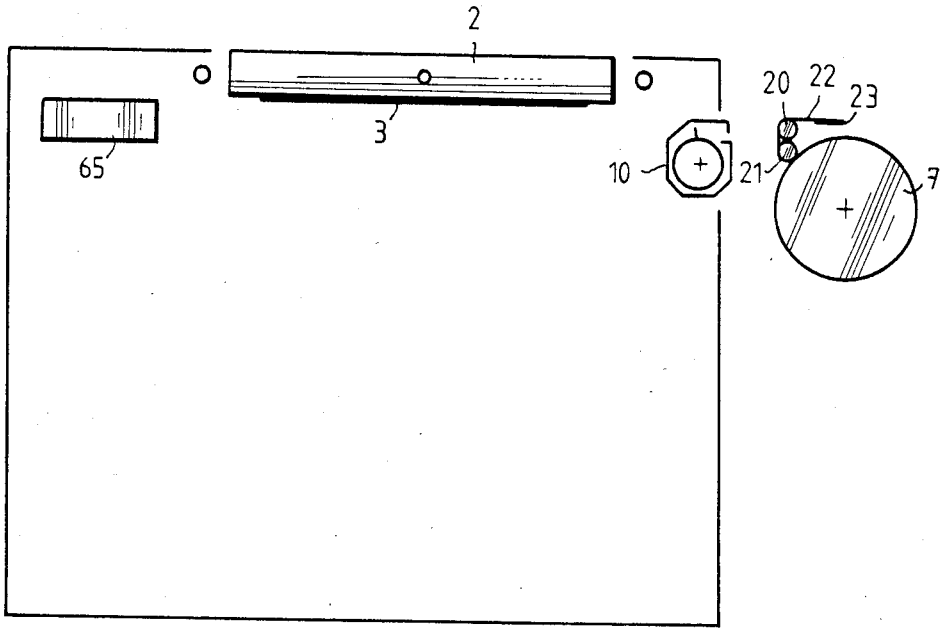
FIGS. 2 to 7 are schematic views illustrating the different phases in the transfer of toner from the photoconductive coating to the final print sheet, FIG. 2*a* illustrating the manner in which the transfer sheet and the print sheet are positioned initially on the drum and FIG. 4*a* illustrating schematically on an enlarged scale a portion on the coating, transfer sheet and pair of rollers.

FIG. 2 illustrates the position of the elements of the invention at the start of the process. The drum 7 with associated guide rollers 20, 21 are arranged in electrically conductive and insulating fashion by connection through circuits, not shown, with voltage sources, also not shown. Moistening unit 10 connected with drum 7 is located on the right and outside of the apparatus so that the drum can be provided with the paper onto which the image formed on the photoconductive coating which carries the charge pattern is to be transferred. Two sheets of paper are wound around the drum 7, these being the print sheet on which the final image is to be transferred and a second transfer sheet by means of which the toner image is removed from the photoconductive coating 3.

This transfer sheet is required in instances where the original from which a representation is to be formed is made of a film which, during exposure, rests with its emulsion side facing down onto the photoconductive coating. Such a position during exposure is advantageous in that no problems are encountered with dot reduction, which occurs when the film is placed with the emulsion side facing upwards. However, one undesirable occurrence is that the image as obtained is reversed in mirror image fashion. By employing a transfer sheet, i.e. an extra transfer stage, a non-reversed image is produced on the final print sheet.

Figure 2A:
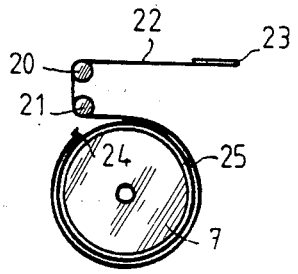

FIG. 2*a* illustrates the manner in which the two sheets are positioned in their initial position around the drum 7. The end of the transfer sheet 22 is fastened on one side to the fixed point 23 and on the other side at point 24 to the drum. The print sheet 25 on which the final image is formed is fastened at approximately the same point 24 and the transfer sheet 22.

Figure 3:
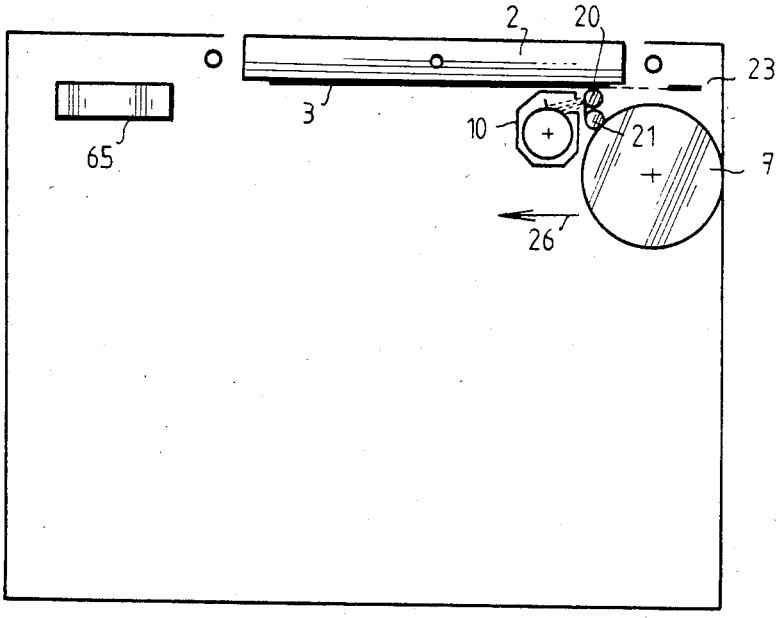

Commencing with the position shown in FIG. 2, the components are moved to the position shown in FIG. 3 and then the transfer paper is wound from right to left (in FIG. 3) along the photoconductive coating 3. During this movement, a voltage V1 is applied to the top roller 20. The polarity of voltage V1 is identical with the toner polarity, so that no toner will adhere to the transfer sheet. The bottom roll carries earth potential (V2). Assuming that the polarity of the charge present on the coating is negative, the polarity of the toner will have to be positive. A positive voltage +V1 is then applied to the roller 20, this being equal to +50 V for a certain photoconductive coating and type of toner employed in actual practice. During movement along the photoconductive coating, the transfer sheet 22 is moistened by the moistening device 10 which is discussed in detail below with reference to FIG. 8.

Figure 4A:
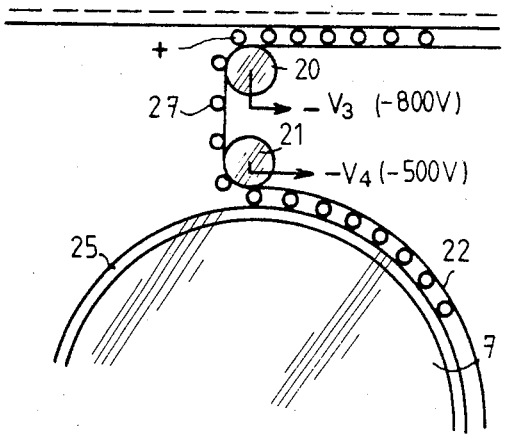
Figure 4:
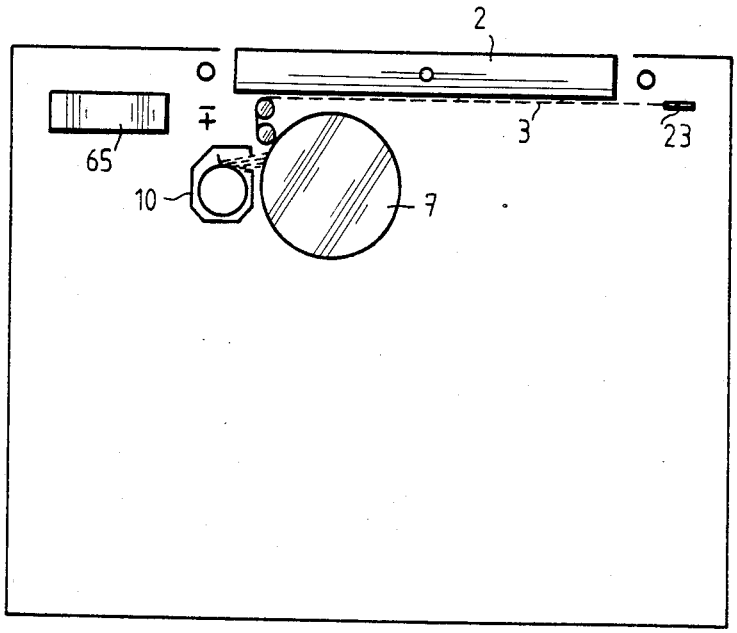

After unwinding, the components assume the position illustrated in FIG. 4. The entire transfer sheet 22 is located underneath the photoconductive coating 3. The toner is still present on the photoconductive coating.

Figure 6:
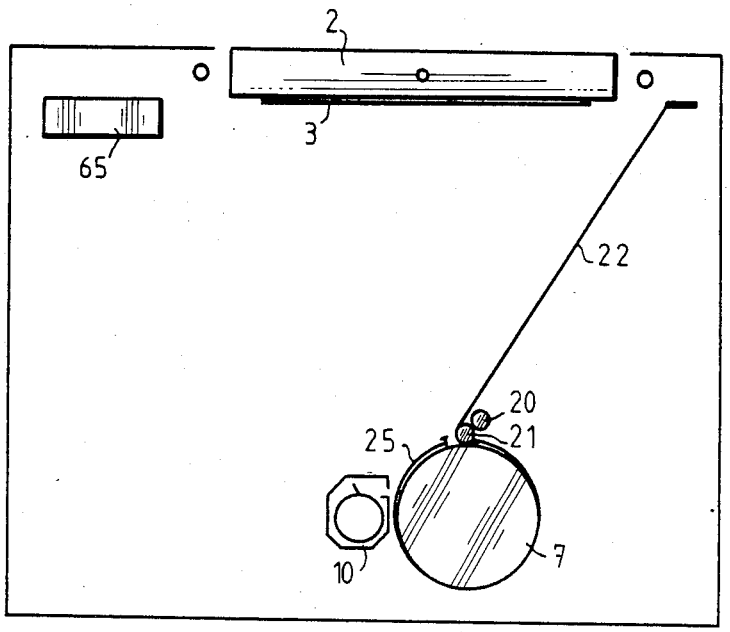

Commencing with the position shown in FIG. 4, the entire assembly is next moved back to the right to reach the end position illustrated in FIG. 6, at which location the transfer sheet 22 is "peeled off" from the coating. During this movement, a negative voltage $-V_3$, $-800$ V is applied to the top roll 20, as a result of which the toner, the polarity of which is positive, transfers from the negatively-charged photoconductive coating to the transfer sheet 22. During this phase a somewhat reduced negative voltage $-V_4$, $-50$ V is applied to the bottom roller, as a result of which the toner remains adhered to the transfer sheet. FIG. 4*a* illustrates schematically and on highly enlarged scale a portion of the coating 3, the transfer sheet 22 and the drum 7 with rollers 20 and 21. The toner particles are indicated in this diagram by the reference numeral 27.

Figure 5:
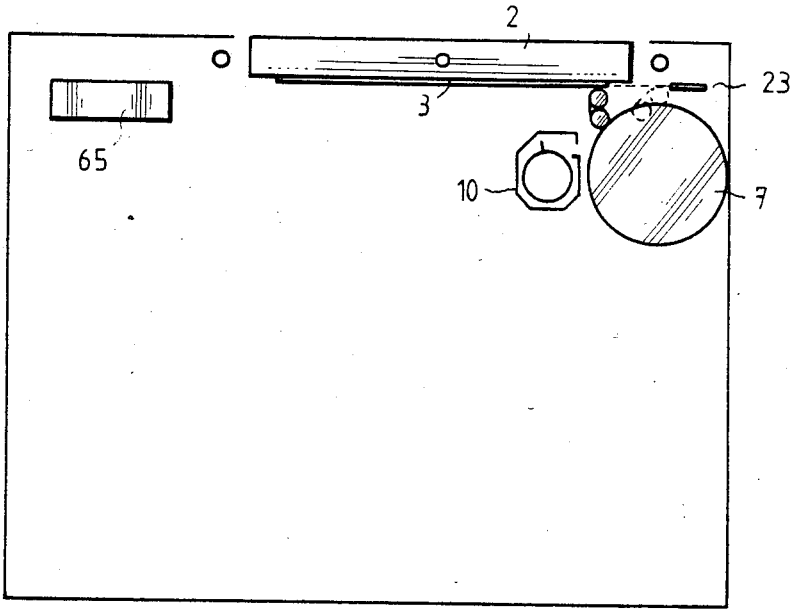

When the last described phase has been completed, the components are in the position shown in FIG. 5 in which the transfer sheet has once again been wound up fully onto drum 7. In this position, the transfer of toner from the transfer sheet to the final print sheet can take place. For this purpose the transfer sheet is once again unwound by starting from the end position shown in FIG. 5 to the position shown in FIG. 6. During such unwinding, earth potential is applied to the top roller 20 and a positive voltage (+V6, +1000 V) is applied to the bottom roller 21.

Figure 7:
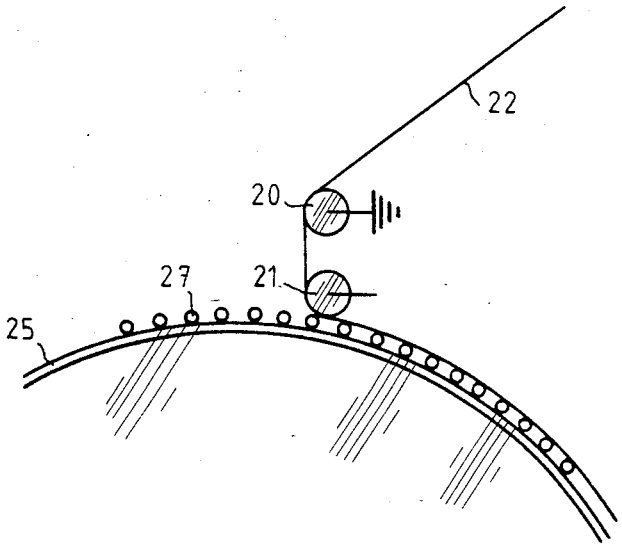

FIG. 7 illustrates, on a very enlarged scale, the position of the elements following the above described action. Transfer of toner takes place from the transfer sheets to the final print sheet. During such transfer action, the moistening device 10 can be put into action to moisten the print sheet with toner solvent so as to facilitate the transfer process.

The print sheet carrying toner image which is obtained can then be removed from the drum if only one image is to be applied thereto. If several partial images of different color are to be brought into registration thereon, the series of operations described above is repeated, but using toner of a different color.

Figure 8:
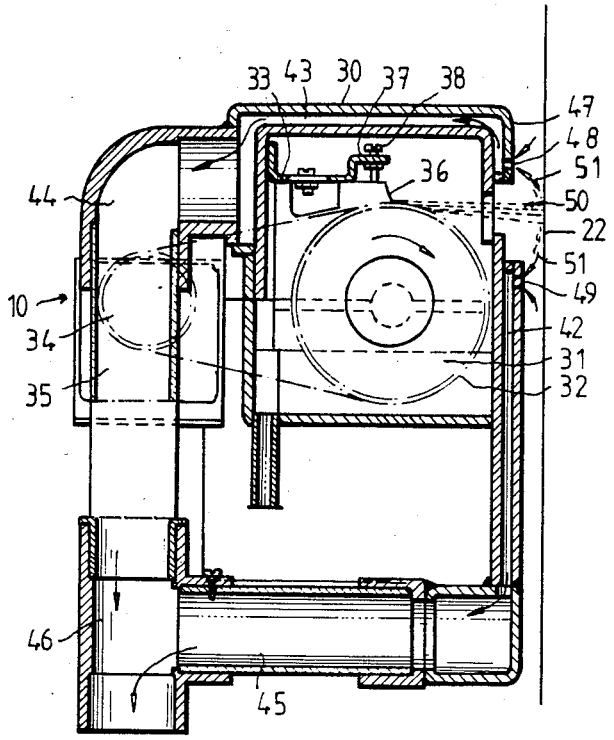
FIG. 8 is a sectional view taken through a preferred embodiment of the apparatus of the invention showing moistening of the acceptor sheets.

As described above, the transfer of toner can be improved by moistening the surface onto which the toner is to be transferrred with toner solvent, but this requires extremely accurate dosage of such solvent, FIG. 8 shows a section of an embodiment of the invention by means of which such accurate dosing can be obtained.

The device 10 consists of a housing 30 in which a rotating brush 31 is mounted. Brush 31 is driven by the motor 35 operating on the wheel 32 on the brush shaft, the drive pulley 33 and the drive wheel 34. The housing also contains a doctor blade 36 fastened to a support 37 by an adjusting screw 38 which permits the radial position of the doctor blade 36 to be adjusted very accurately with respect to the brush circumference. The housing has a discharge aperture 39 for the liquid to be sprayed, which is supplied by the supply device 40 and is maintained at a constant level governed by an overflow, not shown.

The housing is partially double-walled and the channels formed by the means 42, 43 and 44 are connected with a set of suction tubes 45, 46. Suction apertures 48, 49 are located in the front wall 47 of the housing.

The jet 50 can be metered extremely accurately. Any liquid 51 which rebounds from the substrate 22 can be extracted by the apertures 48, 49.

Figure 9:
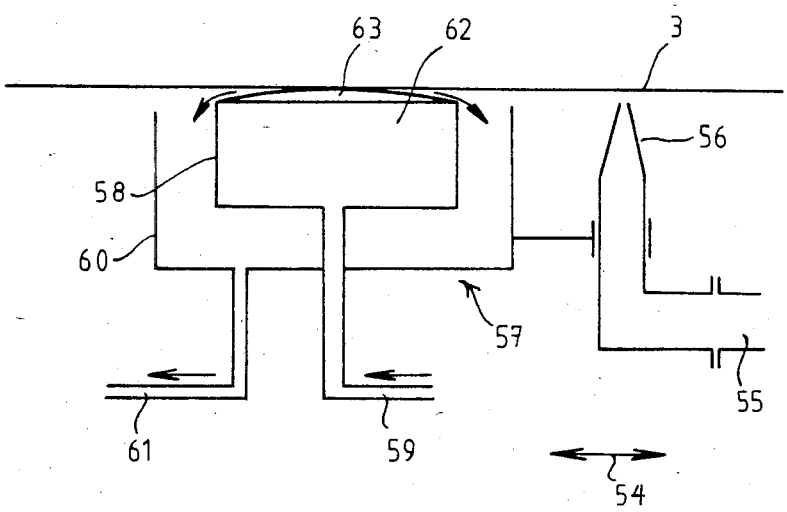
FIG. 9 is a schematic cross-sectional view taken through said apparatus illustrating the manner in which a precisely predetermined quantity of toner solvent is applied to the photoconductive coating.

In certain cases it may be advantageous to re-moisten the layer of toner present on the photoconductive coating prior to transfer thereof to the transfer sheet, such as when the layer of toner has dried out to some extent once again after the application of the toner. For this purpose, a film of liquid of extremely accurately defined thickness must be applied to the coating. The employment shown schematically in FIG. 9 is particularly suitable for this purpose.

The moistening device is combined with a suction nozzle 56, connected with a suction pipe 55, for sucking away excess toner after its application. The entire arrangement can be moved back and forth underneath and along the substrate 3 in the direction shown by the arrows 54.

The toner liquid supply device 57 comprises an overflow chamber 58 connected to the toner liquid supply pipe 59 and placed in a holder 60 to which a toner liquid discharge pipe 61 is connected. The overflow chamber 58 is filled completely with toner liquid 62. This liquid has a meniscus 63, the height of which depends on the liquid characteristics and is constant for a specific liquid. Since the position of the photoconductive coating 3 is fixed during the various operations, by adjusting the distance between the overflow chamber 58 and this coating, the quantity of liquid which is fed to the coating can be determined extremely accurately.

After the toner stage, the entire assembly is moved along the coating. Excess toner is sucked away by the nozzle 56 and by means of the toner liquid supply arrangement the photoconductive coating is moistened, to such a predetermined extent, that good image transfer is ensured.

The device 57 is accommodated in a frame, not shown, which can be moved across suitable guides back and forth underneath the coating and which is schematically illustrated in FIG. 2–6 by the rectangle 65. This frame also accommodates a cleaning unit consisting, for example, of two rollers retained in a holder for toner solvent. After the transfer stage, the cleaning unit is moved along the coating so as to clean it.

Movement of the drum to the position indicated in FIG. 6 during the transfer stage frees the space underneath the support 2. Thereby, after a toner image is transferred to the print sheet, a new charge pattern formed on the other coating of the support 2, which as a result of its 180° rotation is now arranged underneath, can then be developed with toner.

Figure 10:
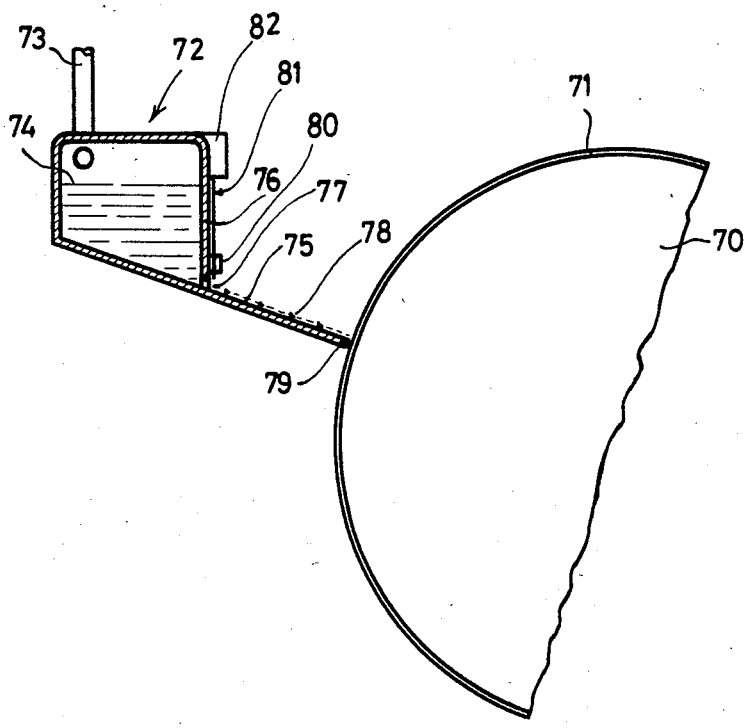
FIG. 10 is a schematic cross-sectional view of an alternate embodiment for moistening the sheets.

FIG. 10 is a schematic illustration of a very simple, but effective embodiment of a moistening device for moistening the transfer sheet or the final print sheet. The drum is indicated in FIG. 10 by reference numeral 70 and the sheet which is wound around the drum is indicated by reference numeral 71. The moistening device comprises a chamber 72 to which toner solvent is supplied through the conduit 73 in such a way that a more or less constant liquid level 74 is maintained in the chamber 72. This chamber is mounted on top of a distributing surface 75 and has a number of outlet openings 77 along the lower edge of the front wall 76 through which a thin layer of fluid 78 flows over the surface 75. The front edge 79 thereof is disposed close to the sheet 71 when the fluid is transferred from said edge to the sheet 71.

The openings 77 can be closed by means of a simple closing strip 80, actuated through one or more operating rods 81 by a suitable mechanism 82, the details of which are not shown.

Minor variations in the structure and other variations in the arrangement and size of the various parts may occur to those skilled in the art without departing from the spirit or circumventing the scope of the invention as set forth in the appended claims.

We claim:

1. Apparatus for transferring a toner image formed on a photoconductive coating to a print sheet from an intermediate transfer sheet comprising, a top guide roller for pressing a transfer sheet over the surface of said coating and thereafter peeling said sheet off from said coating, said top guide roller being maintained during said pressing movement at a potential having a polarity the same as that of the toner charge and being maintained during the peeling off movement at a potential having a polarity opposite to that of the toner charge so as to permit transfer of the toner image to the transfer sheet, means for effecting subsequent transfer of said toner image from the transfer sheet to the print sheet, a frame and acceptor drum mounted in said frame and movable along the surface of the photoconductive coating from an initial position near one end thereof to the other end of said coating and return, means on said drum for holding the print sheet and the transfer sheet wound around the drum, a bottom guide roller coupled for movement with the drum, said top and bottom guide rollers being arranged parallel with the drum a small distance from each other to be brought independently of each other to a potential of selected polarity, the top roller being located farthest away from the drum and being effective for transferring toner from the photoconductive coating to the transfer sheet, said bottom roller being effective for transferring toner from the transfer sheet to the print sheet which is wound around the drum, the direction of winding being such that during winding of the transfer sheet on the drum the side of the transfer sheet carrying the toner image faces against the surface of the print sheet to which the final toner image is to be transferred.

2. Apparatus as claimed in claim 1 in which during unwinding of the transfer sheet along the photoconductive coating means for maintaining the top guide roller at a first potential having a polarity the same as that of the toner polarity during unwinding of the transfer sheet along the photoconductive coating and means for maintaining the bottom guide roller at earth potential, and during peeling off of the transfer sheet from the photoconductive coating the top roller is maintained at a third potential having a polarity opposite to that of the toner polarity and the bottom roller is maintained at a fourth potential having a polarity which is opposite to that of the toner polarity, and during subsequent unwinding of the transfer sheet the top guide roller is maintained at earth potential and the bottom guide roller is maintained at a sixth potential having a polarity the same as that of the toner polarity.

3. Apparatus as claimed in claim 2 in which when positive toners are employed the first potential is approximately +50 V, the third potential is approximately −800 V, the fourth potential is −50 V, and the sixth potential is +1000 V.

4. Apparatus as claimed in claim 1 in which said frame is movable in a direction away from the photoconductive coating during unwinding of the transfer sheet from the coating.

5. Apparatus as claimed in claim 4 including a moistening device movable together with the drum, said moistening device adapted to apply moistening liquid electrically insulating toner carrier to said transfer sheet as the same is unwound from the drum with the print sheet.

6. Apparatus as claimed in claim 5 in which the moistening device includes an oblong chamber with a slot-like liquid discharge aperture, a rotatable brush retained in said moistening device, and a doctor blade arranged proximate to the discharge aperture for interaction with the brush hairs.

7. Apparatus as claimed in claim 5 in which the moistening device includes an oblong downwardly inclined surface positioned with a first edge located proximate to the drum and an opposite edge located below a plurality of outlets for effective controlled supply of said liquid over said surface.

8. Apparatus as claimed in claim 7 in which said outlets are formed in one side wall of an oblong chamber positioned above said surface.

9. Apparatus as claimed in claim 1 in which the photoconductive coating is disposed in a generally horizontal position while the transfer sheet is moved along the coating.

10. Apparatus as claimed in claim 1 including a toner feed device movable in two mutually opposite directions along the photoconductive coating, a suction nozzle, a toner carrier liquid feed device arranged proximate to said nozzle and movable with said toner feed device along the coating, said suction nozzle being operable to suck excess toner away from the coating during return movement of the toner feed device after supply of the toner, said toner carrier liquid feed device being operable to supply a small quantity of toner carrier liquid to the coating after toner is supplied thereto.

11. Apparatus as claimed in claim 10 in which the toner carrier liquid feed device includes a narrow overflow chamber open at the top thereof and movable along the photoconductive coating, an intercept holder including a toner liquid discharge, said overflow chamber being connected to a toner liquid feed pipe and retained in and projecting from said intercept holder.

12. Apparatus as claimed in claim 1 including a moistening device for moistening the surface of the photoconductive coating with toner carrier liquid prior to application of toner thereto.

13. Apparatus as claimed in claim 1 and a housing, said drum being surrounded in part by said housing, said drum and said housing being spaced apart and a suction device communications therebetween.

* * * * *